US007410404B2

(12) United States Patent
Saeki

(10) Patent No.: US 7,410,404 B2
(45) Date of Patent: Aug. 12, 2008

(54) REMOTE CONTROL TOY SYSTEM AND DRIVING DEVICE THEREOF

(75) Inventor: Kazuyuki Saeki, Tokyo (JP)

(73) Assignee: Konami Digital Entertainment Co., Ltd. (JP)

( * ) Notice: Subject to any disclaimer, the term of this patent is extended or adjusted under 35 U.S.C. 154(b) by 667 days.

(21) Appl. No.: 10/510,188

(22) PCT Filed: Jul. 26, 2004

(86) PCT No.: PCT/JP2004/010979

§ 371 (c)(1),
(2), (4) Date: Nov. 16, 2004

(87) PCT Pub. No.: WO2005/009574

PCT Pub. Date: Feb. 3, 2005

(65) Prior Publication Data

US 2006/0019575 A1 Jan. 26, 2006

(30) Foreign Application Priority Data

Jul. 29, 2003 (JP) ..... 2003-282127

(51) Int. Cl.
*A63F 3/00* (2006.01)

(52) U.S. Cl. ..... 446/456; 446/175

(58) Field of Classification Search ..... 446/454–456
See application file for complete search history.

(56) References Cited

U.S. PATENT DOCUMENTS 6,609,945 B2 * 8/2003 Jimenez et al. ..... 446/454
6,672,962 B1 1/2004 Ozaki et al.
2005/0085159 A1 4/2005 Yamaguchi et al.

FOREIGN PATENT DOCUMENTS

| | | | |
|---|---|---|---|
| JP | 2001-149650 A1 | | 6/2001 |
| JP | 2003-164676 A1 | | 6/2003 |
| JP | 2003-164676 A1 | | 6/2003 |
| JP | 2003164676 A | * | 6/2003 |
| WO | WO-99/58214 A1 | | 11/1999 |

OTHER PUBLICATIONS

English translation of JP 2003-164676 A.*

* cited by examiner

*Primary Examiner*—Robert E Pezzuto
*Assistant Examiner*—Alex F. R. P. Rada, II
(74) *Attorney, Agent, or Firm*—Darby & Darby P.C.

(57) ABSTRACT

A driving device (2) which is remotely controlled by a transmitter (1) holds a first parameter (D) and a second parameter (L), transmits an offense signal based on the first parameter (D), and changes the second parameter (L) according to information included in a received specified signal. A remote control system can realize a battle game where the transmitter (1) and the driving device (2) play against another pair of a driving device (2) and a transmitter (1), the driving device (2) receives the offense signal transmitted from the other driving device (2) as the specified signal, and the second parameter (L) is changed according to the information included in the specified signal can be realized in a remote control toy system. In the system, the transmitter (1) allows a control signal to include specified information according to a user's specified operation, and the driving device (2) changes the its own first parameter (D) based on the specified information in the control signal.

6 Claims, 8 Drawing Sheets

FIG. 2

| VEHICLE TYPE | MAIN GUN POWER | LIFE | NUMBER OF BULETTS | LOADING TIME. |
|---|---|---|---|---|
| VEHICLE A | 10 | 40 | 15 | 5sec. |
| VEHICLE B | 8 | 30 | 25 | 4sec. |
| VEHICLE C | 5 | 15 | 40 | 1. 5sec. |
| VEHICLE D | 7 | 25 | 30 | 3sec. |

REMOTE CONTROL TOY SYSTEM AND DRIVING DEVICE THEREOF

CROSS REFERENCE TO RELATED APPLICATION

This is a U.S. national phase application under 35 U.S.C. §371 of International Patent Application No. PCT/JP2004/010979 filed Jul. 26, 2004, and claims the benefit of Japanese Patent Application No. 2003-282127 filed Jul. 29, 2003 which is incorporated by reference herein. The International Application has not published as of the date of filing of this application.

TECHNICAL FIELD OF THE INVENTION

The present invention relates to a remote control toy system and a driving device to be used in this system.

BACKGROUND ART OF THE INVENTION

Remote control toy systems where battle games can be realized by driving devices remotely controlled from transmitters have been already known widely. In the battle games, when player's driving device and an opponent's driving device transmit and receive offense signals including offense information, the offense information damages the opponent's driving device. The result of the battle is determined by accumulation of the damages (see Japanese Patent Application Laid-Open No. 2003-164676).

SUMMARY OF THE INVENTION

In the conventional remote control toy systems where the battle games can be realized, however, a level of the damages given to the opponents due to the offense signals is set in each driving device, and the level of the damages cannot be changed by user's intentions at arbitrary stages during the battle games.

Since only the same level of the damages are always given to the opponent at one offense during the battle, the offense during the battle gets into a rut. For this reason, particularly the users who become accustomed to the control of the battle games get bored with the battle games.

It is an object of the present invention, therefore, to provide a remote control toy system with higher enjoyment where offense during a battle game does not get into a rut, and a user who becomes accustomed to control of the battle game does not get bored with the game.

An embodiment of the present invention solves the above problem by the following methods. A first remote control toy system of the present invention includes: a transmitter which transmits a control signal according to a user's operation; and a driving device which is remotely controlled based on the control signal transmitted from the transmitter, and the driving device includes: a storage device which holds a first parameter and a second parameter; an offense signal transmitting device which transmits an offense signal including offense information based on the first parameter; and a second parameter change device which receives a specified signal for changing the second parameter and changes the second parameter according to information included in the specified signal. The transmitter and the driving device are combined with another pair of another driving device and another transmitter having the storage device, the offense signal transmitting device, and the second parameter change device, so as to be capable of playing a battle game. In a battle game, in the remote control system where the driving device receives the offense signal as the specified signal transmitted from the another driving device and changes the second parameter according to the information in the specified signal, the transmitter has a control signal generating device which allows the control signal to include specified information according to a specified operation by a user, and the driving device has a first parameter change device which changes the first parameter of the driving device based on the specified information included in the control signal.

In the battle game of the embodiment of the invention, a plurality of the driving devices take part in the battle game, each having the first parameter and the second parameter, and transmitting the offense signal including the offense information based on the first parameter to the opponents' other driving devices in order to launch an attack. The offense information may be based on the first parameter, that is, may be the first parameter itself, or may be processed first parameter. On the other hand, when the offense signal transmitted from another driving device as an opponent is received as a specified signal, the second parameter of the driving device is changed according to information in the specified signal. That is, since the offense signal includes the offense information, the second parameter of the driving device is changed according to the offense information. The offense information is based on the opponent's first parameter.

The second parameter of the driving device is, therefore, changed based on the opponent's first parameter. If the second parameter is so-called endurance of the driving device, and the first parameter is the offense power, the battle game can be provided, where the endurance of the driving device changes based on the opponent's offense power. In another pair of the another transmitter and the another driving device which plays the battle game, the driving device is enough to have at least the storage device, the offense signal transmitting device, and the second parameter change device. Different appearance and different constitutions other than that for playing the battle game can be applied.

In the remote control toy which can realize such a battle game, when the user performs the specified operation, the control signal including specified information according to the operation is transmitted from the transmitter, and the first parameter change device of the driving device changes the first parameter of the driving device based on the specified information. "Based on the specified information" means that the specified information in the control signal becomes a trigger. As a result, since the contents of the offense information of the driving device are changed, the state of changing the opponent's second parameter due to the offense of the driving device can be changed. "The parameters" represent a level and a state, and they may be numerical values or characters.

"The parameters are changed" means that a level and a state represented by the parameters are changed, and it includes both an advantageous case and a disadvantageous case in the battle game as the result of changing the parameters. The change in the first parameter brings, therefore, advantageous situation or disadvantageous situation for the battle play in comparison with the normal case, so that the contents of the battle game can be varied. For example, the first parameter can be changed in order to bring the advantage situation, and also the battle game can be considered by combining other processes, where very high advantageous situation for the battle game can be obtained instead of the disadvantageously changed first parameters. The mode of the "specified information according to a specified operation by a user" includes an occasion of an operation signal according to a user's operation on the transmitter, or an occasion where the a flag representing the specified information is raised, and both the occasions.

Further, in another embodiment of the first remote control toy system of the present invention, the first parameter and the second parameter are expressed by numerical values, and the offense signal transmitting device transmits the offense signal including the first parameter, in the battle game, the second parameter change device changes the value of the second parameter according to the value of the value of the first parameter included in the offense signal received as the specified signal, and the first parameter change device changes the first parameter of the driving device based on the specified information. As a result, since the parameters can be processed as numerical values, the state of the change in the first parameter of the driving device, and the state of the change in the second parameter of another driving device which changes based on the change of the first parameter of the driving device can be expressed according to the change in the numerical values.

Further, the second parameter change device reduces the value of the first parameter included in the offense signal from the second parameter so as to change the value of the second parameter, and the first parameter change device increases the first parameter of the driving device based on the specified information. As a result, when it is assumed that the change in the second parameter of the driving device due to the offense signal from another driving device is a damage, a value is obtained only by subtracting the first parameter as the offense signal of another driving device from the second parameter as the endurance of the driving device so that the value can be regarded as its own damage due to opponent's offense power. Only the first parameter is increased, so that the offense power of the driving device can be heightened.

The first parameter change device in the first remote control toy system according to the embodiment of the present invention returns the first parameter changed based on the specified information to a state before the change, according to a predetermined condition. As a result, even if the first parameter is once changed by the user's specified operation, it can be returned to the original state, thereby the change state of the first parameter in the battle game can be positioned as a special state. "The predetermined condition" may include occasions that a user performs or does not perform a predetermined operation on the transmitter, or elapsed time after the change.

In another embodiment of the present invention, a driving device is remotely controlled based on a control signal transmitted from a transmitter according to a user's operation, and includes: a storage device which holds a first parameter and a second parameter; an offense signal transmitting device which transmits an offense signal including offense information based on the first parameter; and a second parameter change device which receives a specified signal for changing the second parameter and changes the second parameter according to information included in the specified signal. The driving device can play a battle game with another driving device which is controlled by another transmitter, the another driving device having the storage device, the offense signal transmitting device, and the second parameter change device. In the battle game, the driving device in a remote control toy system receives the offense signal transmitted from the another driving device as the specified signal, and changes the second parameter according to the information included in the specified signal. The driving device further includes a first parameter change device which when the control signal including specified information according to a specified operation by a user is received from the transmitter, changes the first parameter of the driving device based on the specified information. As a result, the driving device can be used as the driving device of the first remote control system.

Further, in another embodiment of the present invention, a second remote control toy system includes: a transmitter which transmits a control signal according to a user's operation; and a driving device which is remotely controlled based on the control signal transmitted from the transmitter. The driving device includes: a storage device which holds a first parameter and a second parameter; an offense signal transmitting device which transmits an offense signal including offense information based on the first parameter; and a second parameter change device which receives a specified signal for changing the second parameter and changes the second parameter according to information included in the specified signal. The transmitter and the driving device are combined with another pair of another driving device and another transmitter having the storage device, the offense signal transmitting device, and the second parameter change device, so as to be capable of playing a battle game. In the battle game, in the remote control toy system where the driving device receives the offense signal transmitted from the another driving device and changes the second parameter according to the information in the specified signal, the transmitter has a control signal generating device which allows the control signal to include specified information according to a specified operation by a user, and the driving device has a relationship change device which changes a relationship between the second parameter of the driving device and the information included in the specified signal received from the another driving device based on the specified information included in the control signal.

The second remote control toy system can realize a battle game similar to the battle game in the first remote control toy system, and when the driving device receives the specified information according to the user's specified operation, the relationship between the second parameter of the driving device and the information included in the specified signal transmitted from another driving device, namely, the offense information in the offense signal is changed. The driving device which receives the control signal including the specified information can change a level of the change in the state of the second parameter of the driving device as endurance due to the offense information from another driving device. For example, it is assumed that the state of the first parameter of another driving device included in the received specified signal is a damage so as to deteriorate the state of the second parameter of the driving device. If the level of the deterioration gets heightened, the self defense power becomes weakened. If the level of the deterioration gets small or is not changed, the self defense power can become heightened. An example of the battle game which can be realized by increasing or decreasing the self defense power is similar to that in the first remote control system. Further, "based on the specified information", "parameter", "the parameter is changed", and "the specified information according to a specified operation by a user" are similar to those in the first remote control system.

According to an embodiment of the present invention, the parameter representing the offense power of the driving device is changed, or the relationship between the parameter representing the endurance and the parameter representing the opponent's offense power is changed, and thereby the remote control toys system with higher enjoyment can be provided, where the offense during the battle game does not get into a rut, the user which is accustomed to the operation in the battle game does not get bored with the battle game, and a savor of the game is improved.

BRIEF DESCRIPTION OF THE DRAWINGS

FIG. 2 is a diagram showing a list of parameters of the combat vehicle model in FIG. 1;

BEST MODE FOR CARRYING OUT THE INVENTION

Figure 1:
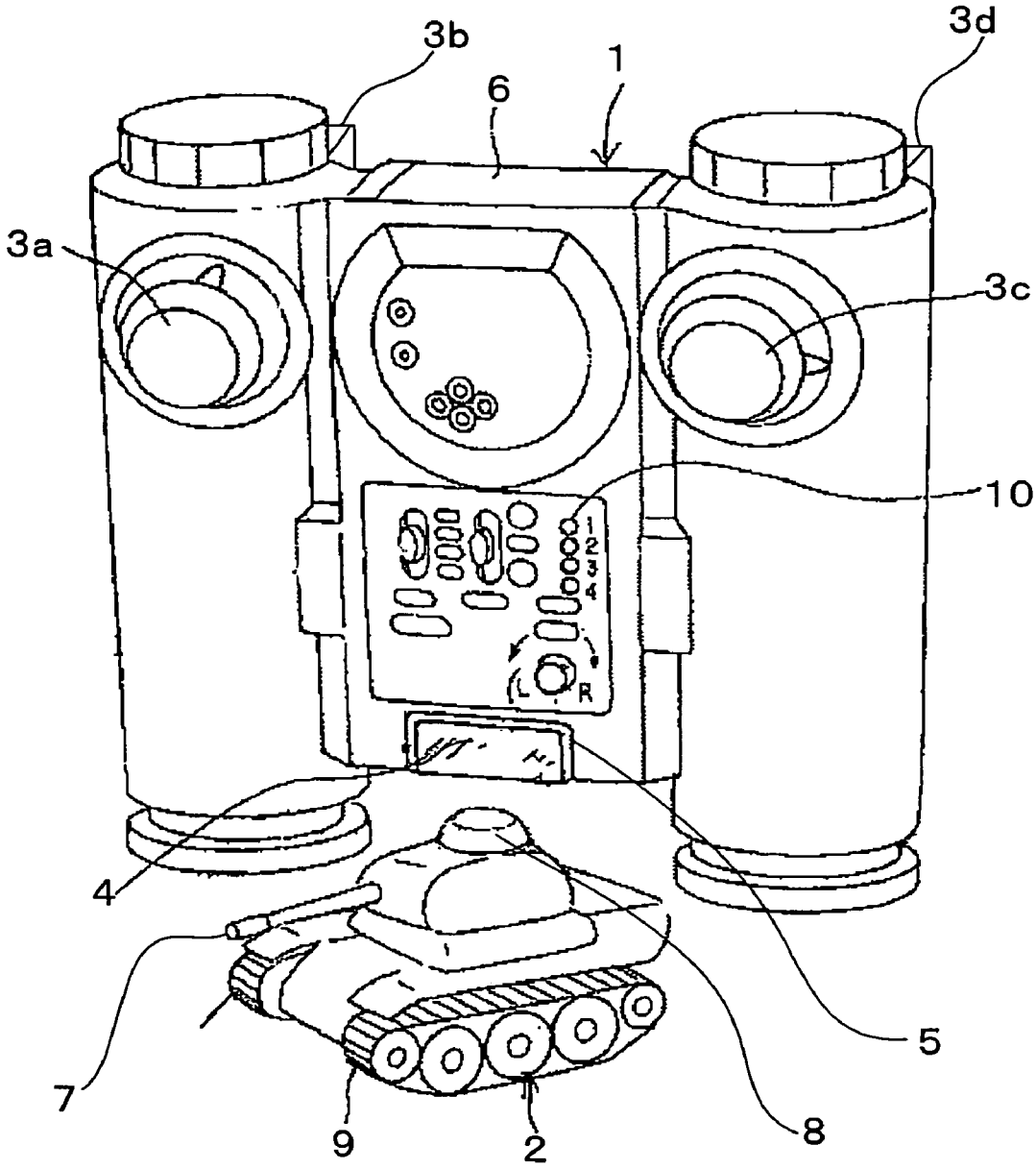
FIG. 1 is a diagram showing one embodiment for carrying out the present invention.

FIG. 1 is a diagram showing a transmitter 1 and a combat vehicle model 2 as a driving device according to a first embodiment for carrying out the invention. The transmitter 1 has a plurality of operating members 3*a* . . . 3*d*, a ROM installing device 5 where a vehicle-by-vehicle ROM 4, which is detachable, a remote control signal transmitter/receiver 6 which transmits/receives a control signal, and an ID setting button 10. The vehicle-by-vehicle ROM 4 stores parameters relating to offense ability and defense ability of the command vehicle model 2 therein. A user installs the vehicle-by-vehicle ROM 4 storing desired parameters to the ROM installing unit 5 so as to be capable of operating the command vehicle model 2 having the desired offense ability and defense ability with the transmitter 1.

The operating members 3*a* . . . 3*d* include stick 3*a* which tilts to front and rear sides, a stick 3*c* which tilts to right and left sides, and rear buttons 3*b* and 3*d*. The user operates them so as to be capable of remotely controlling the command vehicle model 2. The command vehicle model 2 has a shooting signal transmitter 7 as an offense signal transmitting device, a receiver 8, and traveling wheels 9. The shooting signal transmitter 7 transmits a shooting signal as an offense signal, and the receiver 8 receives a shooting signal from another command vehicle model 2 and a control signal from the transmitter 1. "To transmit the shooting signal" is hereinafter sometimes called "to shoot", and to receive the shooting signal from another command vehicle model is sometimes called "to be shot".

The remote control toy in this embodiment uses infrared rays as a carrier wave of data. The transmitter 1 and the command vehicle model 2 combined with the transmitter 1 have the same ID number. The transmitter 1 transmits the control signal including the self ID number, and when the ID number included in the control signal received by the command vehicle model 2 matches with the self ID number of the command vehicle model 2, the command vehicle model 2 recognizes that the control signal has been transmitted to itself. As a result, in the battle game in which each of the transmitters 1 operates the corresponding command vehicle models 2, the command vehicle model 2 can discriminate the control signal transmitted to itself. The ID setting buttons 10 provided onto the transmitters 1 can set the ID numbers of the respective sets. In this embodiment, as shown in FIG. 1, the ID numbers 1 to 4 are prepared, and the battle game can be played by using up to four sets of the transmitters 1 and the command vehicle models 2. The control signals to be transmitted from the transmitters 1 to the command vehicle models 2 always have the same data length, and each of the transmitters 1 adjusts its own transmission timing so that their transmission timings do not overlap one another so as to prevent cross talk between the sets. Information in the control signals is explained later.

A summary of the battle game to be played by the remote control system shown in FIG. 1 is explained below. The command vehicle model 2 has the parameters relating to the offense ability and the parameters relating to the defense ability stored in the vehicle-by-vehicle ROM 4 provided onto the transmitter 1 combined with the model 2. The parameters stored in the vehicle-by-vehicle ROM 4 are shown in FIG. 2. As shown in FIG. 2, the battle ability of the command vehicle model 2 is determined by a main gun power as a first parameter, a life as a second parameter, a number of bullets, and loading time. The main gun power represents a damage (offense power) to be given to an opponent by one shooting, the life represents tolerance (endurance) against offense in one game. A number of bullets means a number of shootings allowed in one game, and the loading time means time required for the command vehicle model 2 from one shooting to next shooting.

FIG. 2 shows each parameter corresponding to four types of command vehicles A to D. For example, in the case of the command vehicle model A which is remotely controlled by the transmitter 1 onto which the vehicle-by-vehicle ROM 4 storing the parameters of the command vehicle model A (hereinafter, only "command vehicle A") is provided, the values of the parameters are set to 10 as the main gun power, 40 as the life, 15 as a number of the bullets, and 5 as the loading time. When the command vehicle A receives an offense signal transmitted from the command vehicle model 2 having the parameters of the command vehicle model B (hereinafter, "command vehicle B), namely, is shot, the value of the main gun power of the command vehicle B becomes damage, 8 is subtracted from 40 of the command vehicle A so that the life of the command vehicle A becomes 32. In such a manner, the life changes according to shot, and for example, a battle game can be placed in order to determine the victory and defeat by comparing the values of the life of the command vehicle models 2 after constant time passes.

In this embodiment, during the battle game, within the data stored in the vehicle-by-vehicle ROM 4, the main gun power and the life are held by the command vehicle model 2, and a number of bullets and the loading time are held by the transmitter 1. In an embodiment of the present invention, the value of the main gun power held by the command vehicle model 2 can be temporarily increased by a user's instruction. This instruction is "charge instruction" hereinafter, and the process of increasing the main gun power is a "charge process". The "charge process" includes two kinds of processes which are a charge process 1 and a charge process 2 for increasing the main gun power. The respective processes are detailed later. The main gun power stored in the vehicle-by-vehicle ROM 4 is called as a "standard value", and to increase the main gun power is sometimes described as "to raise the level of the main gun power".

Figure 3:
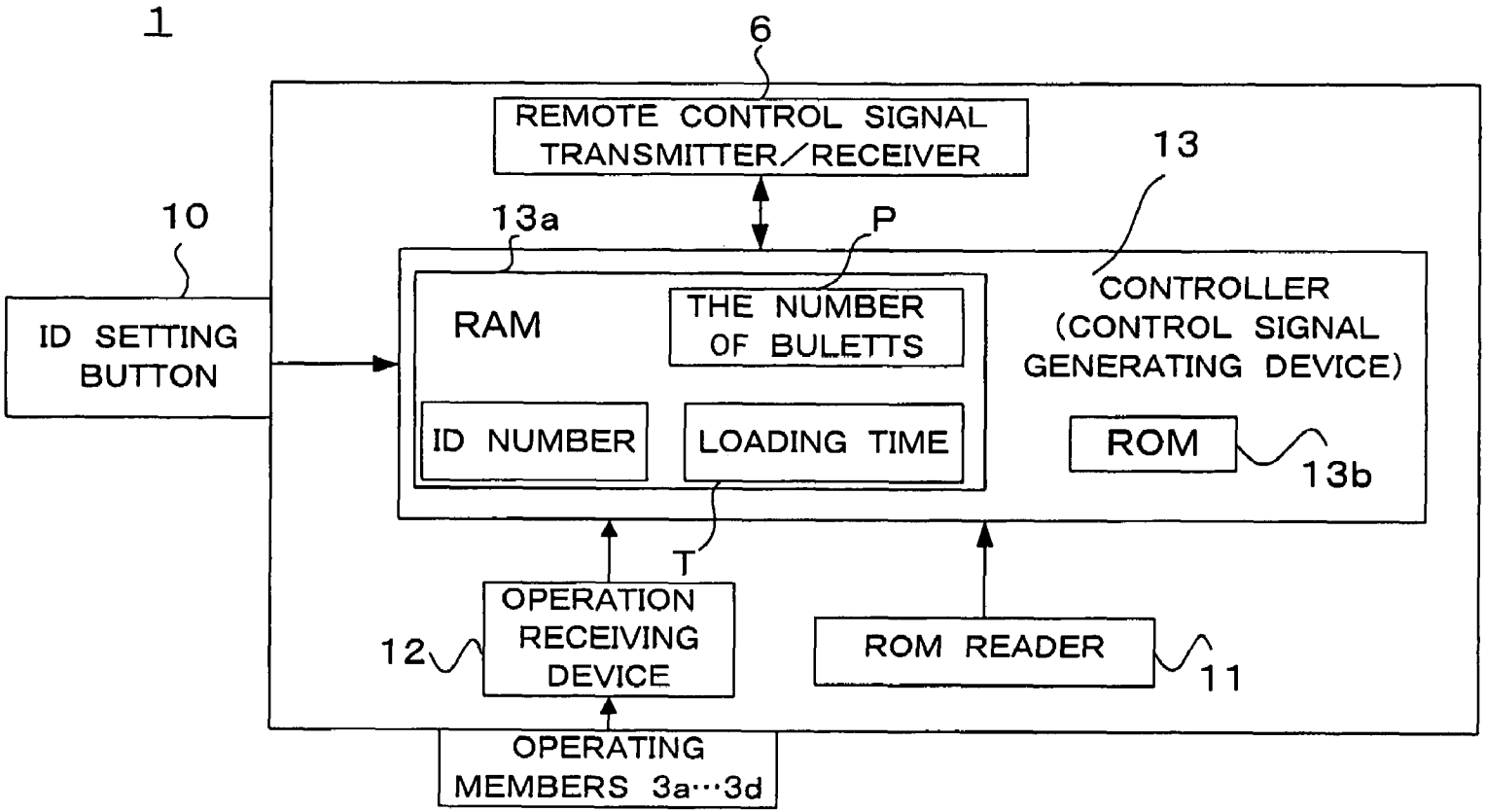
FIG. 3 is a functional block diagram of the transmitter in FIG. 1.
Figure 4:
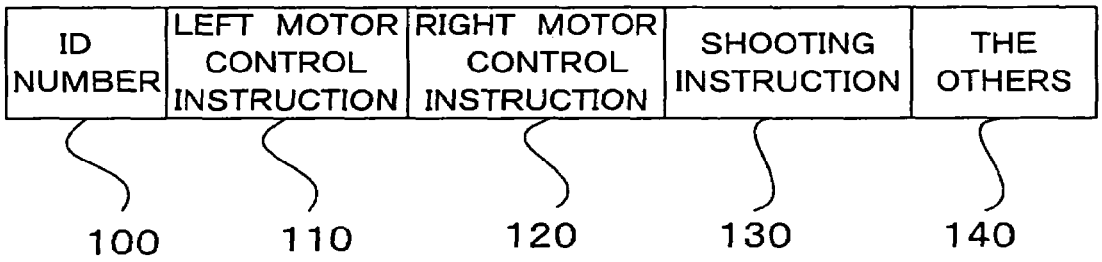
FIG. 4 is a diagram showing fields included in a control signal transmitted from the transmitter in FIG. 1.

The processes up to the transmission of a control signal from the transmitter 1 are explained with reference to FIGS. 3 and 4. FIG. 3 is a functional block diagram of the transmitter 1, and FIG. 4 is a diagram showing information included in the control signal transmitted from the transmitter 1. The transmitter 1 has the remote control signal transmitter/receiver 6 which transmits/receives a control signal, the ID setting button 10, a ROM reader 11 which reads data stored in the vehicle-by-vehicle ROM 4, an operation receiving device 12 which receives user's input operation to the operating members 3*a* . . . 3*d*, and a controller 13 which receives signals from respective devices provided to the transmitter 1 and executes processes based on the signals. The controller 13 has a CPU and various peripheral circuits such as, a RAM 13*a* and a ROM 13*b* necessary for operating the CPU, and functions particularly as a control signal generating device.

Each of the number of bullets P and the loading time T within the parameters read from the vehicle-by-vehicle ROM 4 by the ROM reader 11 is read by the RAM 13*a* and are held therein. The ID number set by the ID setting button 10 is also held in the RAM 13*a*. A program for controlling the process to be executed by the controller 13 is stored in the ROM 13*b*. Operations which are received by the operation receiving device 12 include a traveling instruction, a shooting instruction, and a charge instruction as a specified operation.

When the user performs the input operation to the operating members 3*a* . . . 3*d*, the operation receiving device 12 generates an operating signal according to the operation so as to transmit it to the controller 13. The controller 13 as the control signal generating device generates a control signal according to contents of the operating signal. The control signal has an ID number field 100, a left motor control instruction field 110, a right motor control instruction field 120, a shooting instruction field 130, and the others field 140 as shown in FIG. 4. The ID number field 100 indicates an ID number set to the transmitter 1. An ID number which is held by the RAM 13*a* is written therein.

When the user operates any of the operating members 3*a* . . . 3*d*, information according to the input operation is written into the left and right motor control instruction fields 110 and 120, and the shooting instruction field 130. When an input operation related to information to be written is not performed, these fields are left blank. The 5-bit left motor control instruction field 110 and the 5-bit right motor control instruction field 120 are provided, and information related with an operating amount of the sticks 3*a* and 3*c* is written into the fields 110 and 120. Straight movement or backward movement can be instructed by the left stick 3*a*, and rotating movement can be instructed by the right stick 3*c* in this embodiment. As described later, the driving device has one left motor and one right motor, and respective information in the left and the right motor control instruction fields 110 and 120 is related with driving of the left and the right motors. The shooting instruction field 130 is related with the operation of the rear buttons 3*b* and 3*d*, and it is 1-bit flag. When any of the rear buttons 3*b* and 3*d* is pushed down, the flag of the shooting instruction field 130 is raised.

When the user performs an input operation representing the charge instruction, information representing the charge instruction as specified information is written into the right motor control instruction field 120 and the shooting instruction field 130. As a result, the field for the charge instruction does not have to be specially provided to the control signal. In this embodiment, two kinds of the charge processes are present, and when the right stick 3*c* is tilted left while the left rear button 3*b* is being pushed down, the charge process 1 is represented. When the right stick 3*c* is tilted right while the left rear button 3*b* is being pushed down, the charge process 2 is represented.

For example, it is assumed that when the right stick 3*c* is tilted left, the right motor control instruction field 120 indicates "00001", and when the left rear button 3*b* is pushed down, the shooting instruction field 130 indicates "1". The charge instruction 1 representing the charge process 1 is "000011" obtained by combining the right motor control instruction field 120 and the shooting instruction field 130. If the right motor control instruction field 120 indicates "11000" at the time of tilting the right stick 3*c* right, the charge instruction 2 representing the charge process 2 indicates "110001". While the user is performing the input operation for the charge instruction, the operation receiving device 12 ignores the input operation on the left stick 3*a*, and a signal related with the operation of the left stick 3*a* is not transmitted to the controller 23.

On the other hand, when the user inputs the shooting instruction, a control signal is generated and the number of bullets P is reduced by one. Further, the shooting instruction is again given at the time when the loading time T does not elapse from the time of the last shooting instruction, the control signal for the shooting instruction is not generated. Hereinafter, the control signal "includes the instructions" or "an instruction is given" is described to mean a state that the information related with the instructions is written into the left and the right motor control instruction fields 110 and 120, and the shooting instruction field 130.

Figure 5:
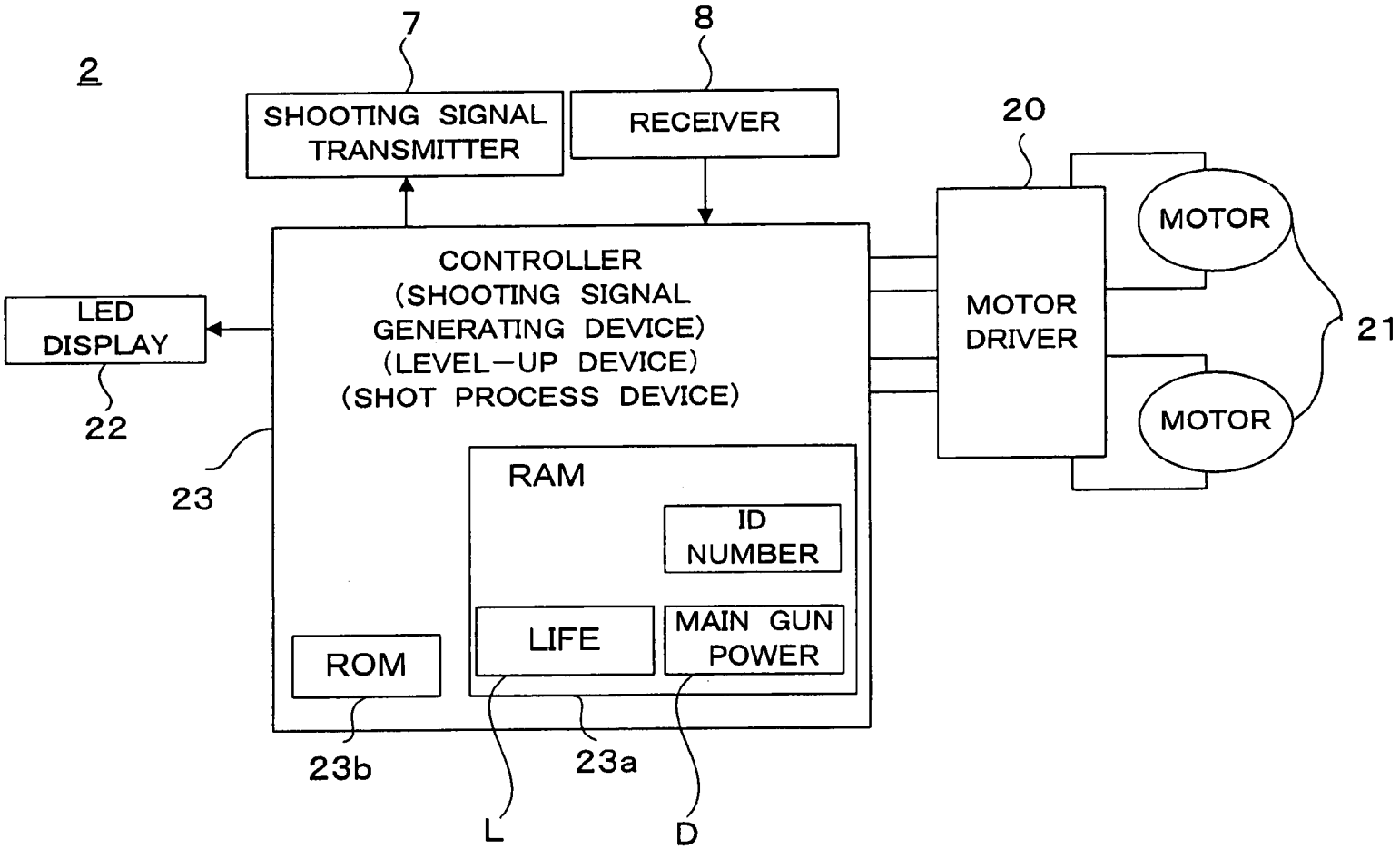
FIG. 5 is a functional block diagram of the combat vehicle model in FIG. 1.

The process to be executed in the command vehicle model 2 when it receives the control signal is explained with reference to FIGS. 5 to 8. FIG. 5 is a functional block diagram of the command vehicle model 2. The command vehicle model 2 has a shooting signal transmitter 7, a receiver 8, a motor driver 20 and a motor 21 for traveling of the command vehicle model 2, an LED display device 22 which emits light according to a state of the command vehicle model 2, and a controller 23 which controls the operations of the respective devices in the command vehicle model 2. The controller 23 has various peripheral circuits such as a CPU, a RAM 23*a* and a ROM 23*b* necessary for operating the CPU. The controller 23 functions as particularly a shooting signal generating device, a level-up device as a first parameter change device, and a shot process device as a second parameter change device. The RAM 23*a* as the storage device which holds the first parameter and the second parameter retains the main gun power D as the first parameter, and the life L as the second parameter, and the ID number. The value of the parameters of the main gun power D and the life L retained in the RAM 23*a* are the main gun power and the life recorded in the vehicle-by-vehicle ROM 4 provided to the combined transmitter 1. The ID number is the ID number set for the combined transmitter 1. The main gun power, the life, and the ID number are set by, for example, transmitting the data including these values from the transmitter 1 to the command vehicle model 2 at the time of starting the game.

The ROM 23*b* records programs for controlling the various processes to be executed by the controller 23. A pair of the motors 21 are provided symmetrically, and they drive the right and the left traveling wheels 9 independently. The controller 23 as the shooting signal generating device generates a shooting signal as an offense signal using the main gun power D of the controller as the offense information. When the controller 23 as the shot process device receives the shooting signal as a specified signal emitted from another command vehicle model 2, it executes a process according to information included in the shooting signal. Additionally the controller 23 as the level-up device changes the value of its own life L. The details of the processes are explained later.

Figure 6:
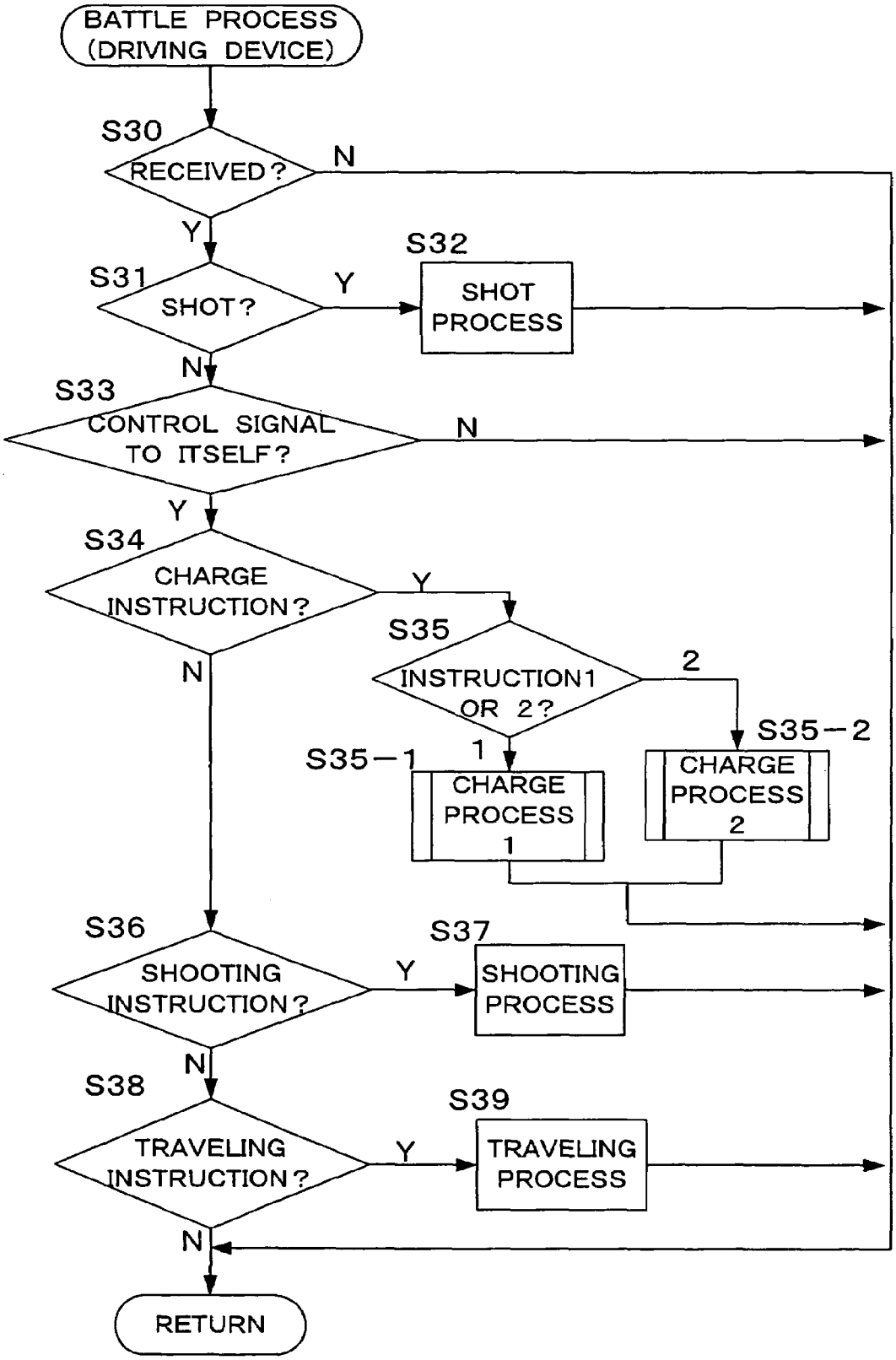
FIG. 6 is a flowchart showing a flow of a battle process to be executed by the combat vehicle model in FIG. 1.

When the command vehicle model 2 receives the offense signal or the control signal from another command vehicle model 2, the controller 23 executes a battle process to be executed during the battle game. This process will be described below. FIG. 6 is a flowchart showing the flow of the battle process to be executed by the controller 23. It is monitored whether the receiver 8 receives the control signal or the shooting signal from another command vehicle model 2 (step S30). When the receiver 8 receives the signal, it is judged whether it represents shot (step S31). When the received signal is the shooting signal and the shooting signal includes a number other than its self ID number, it is judged that it is the shot to execute the shot process (step S32). In the shot process, the controller 23 as the shot process device subtracts the value of the main gun power of the opponent included in the received shooting signal from the value of its own life L, so as to change its own life L. After the shot process, the battle process returns to a reception monitoring state. In the shot process, the LED display device 22 is made to emit light, and the state of the light emission may be changed depending on the changed value of life L.

When it is judged that the signal does not represent the shot at step S31, it is judged whether the control signal has been transmitted to itself (step S33). When the received control signal includes the self ID number, it is judged that the control signal has been transmitted to itself, and the sequence proceeds to step S34. When the received control signal does not include the self ID number, the battle process returns to the reception monitoring state. It is judged whether the control signal includes the charge instruction (step S34). When the control signal includes the charge instruction, it is judged whether the contents of the charge instruction indicate the charge instruction 1 or the charge instruction 2 (step S35). When the contents indicate the charge instruction 1, the charge process 1 is executed (step S35-1), and when the contents indicate the charge instruction 2, the charge process 2 is executed (step S35-2). It is judged according to states of the right motor control instruction field 120 and the shooting instruction field 130 of the control signal which charge instruction 1 or 2 the contents of the charge instruction instructs. After the respective charge processes are completed, the battle process returns to the reception monitoring state.

When it is judged that the control signal does not include the charge instruction at step S34, it is judged whether it includes the shooting instruction (step S36). When the control signal includes the shooting instruction, the sequence proceeds to the shooting process (step S37). When a flag is raised in the shooting instruction field of the control signal, the control signal is judged as the shooting instruction. In the shooting process, the controller 23 as the shooting signal generating device generates a shooting signal including its own main gun power D and the self ID number, and the shooting signal transmitter 7 transmits the shooting signal. After the shooting process, the battle process returns to the reception monitoring state.

When it is judged that the control signal does not include the shooting instruction at step S36, it is judged whether it includes a traveling instruction (step S38). When it includes the traveling instruction, the traveling process is executed (step S39). When information is written into the left and the right motor control instruction fields 110 and 120, or when information is written any one of the fields, it is judged that the control signal includes the traveling instruction. In the traveling process, the operations of the right and the left motors 21 are controlled based on the information written in the left and the right motor control instruction fields 110 and 120. After the traveling process, the battle process returns to the reception monitoring state.

Figure 7:
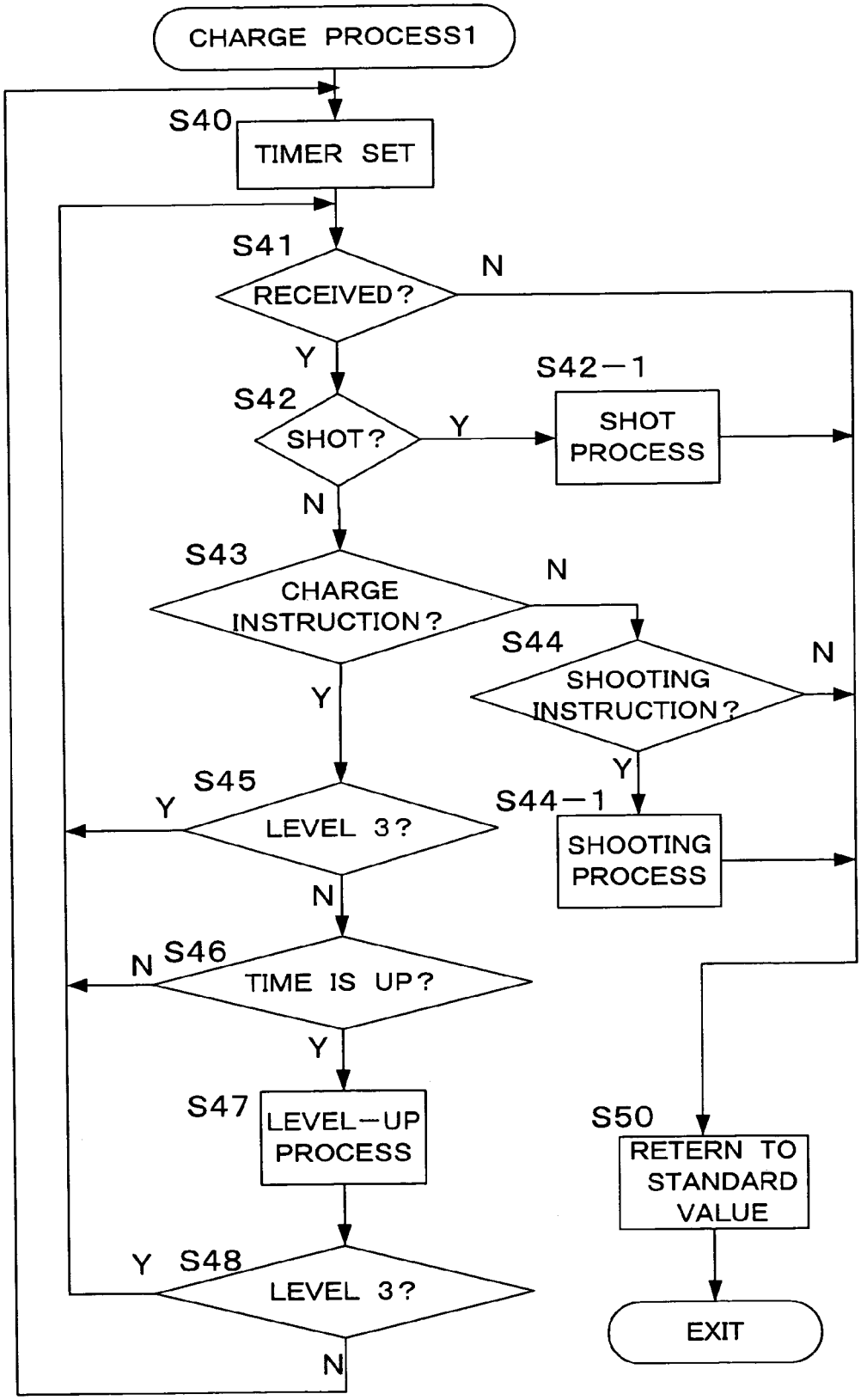
FIG. 7 is a flowchart showing a flow of a charge process 1 to be executed by the combat vehicle model in FIG. 1.

The charge process 1 to be executed by the controller 23 will be described according to the flowchart in FIG. 7. A timer is set (step S40). The timer counts up 1 second. When the timer counts up, the main gun power D can be increased. If the control signal including the charge instruction signal representing the charge instruction 1 is not continuously being received during counting the timer, the charge process 1 ends. Also when the command vehicle model 2 is shot or receives the control signal including the shooting instruction, the charge process 1 ends.

At steps S41 to S44, therefore, the reception state of the receiver 8 is monitored. It is judged whether the receiver 8 receives the control signal transmitted to itself or the shooting signal from another command vehicle model 2 (step S41). When the receiver 8 does not receive the signals, the sequence proceeds to step S50 to cancel the charge process 1. It is judged that the receiver 8 receives the signals, it is judged whether the command vehicle model 2 is shot (step S42). When it is judged that the command vehicle model 2 is shot, the shot process is executed (step S42-1). The judgement as to the shot and the processes to be executed in the shot process are similar to those in the battle process. After the shot process, it is judged that the charge process 1 is canceled, and the sequence proceeds to step S50.

When it is judged that the command vehicle model 2 is not shot at step S42, it is judged whether the received control signal includes the charge instruction (step S43). When it is judged that the control signal does not include the charge instruction, it is judged whether it includes the shooting instruction (step S44). When the control signal includes the shooting instruction, the shooting process is executed (step S44-1). After the shooting process, the sequence proceeds to step S50. When it is judged that the control signal received at steps S43 and S44 does not include the charge instruction nor the shooting instruction, the sequence proceeds to step S50. The judgement whether the control signal includes the charge instruction or the shooting instruction, and the shooting process are similar to those in the battle process.

When the control signal including the charge instruction is received, it is judged whether a current level is 3 (step S45). This level means a level of the main gun power D, and as the main gun power D becomes larger by the execution of the charge instruction, the level becomes larger. In this embodiment, a state of a standard value is level 0, and the main gun power D has three levels: 1 to 3. The command vehicle model 2 which is at the level 3 is not leveled up any more even if the charge instruction is given. In the case of the level 3, therefore, the sequence returns to step S41 so as to be in the reception monitoring state. In the charge process 1, even in the case of the level 3, if the control signal including the charge instruction 1 is not continuously being received, the charge process 1 ends. It is, therefore, necessary for the user to continuously input the charge instruction 1 into the transmitter 1 until the shooting instruction is input at suitable time.

When the level is not 3, it is judged whether the timer counts up the time (step S46). When the timer counts up the time, the level-up process is executed (step S47). In the level-up process, the controller 23 as the level-up device increases the main gun power D by 1, increases the level by one, and makes the LED display device blink for 1 second. The brightness of the LED becomes higher as the level becomes larger. When the timer does not count up the time, the sequence returns to step S41 so as to be in the reception monitoring state.

As a result of the level-up process at step S47, it is judged whether the current level is 3 (step S48). When the level is 3, the sequence returns to step S41 so as to be in the reception monitoring state at the level 3. When the level is not 3, the sequence returns to step S40 in order to increase the main gun power D to next level, and the sequence is in the reception monitoring state after the timer is set.

When it is judged that the receiver 8 does not receive any signal at step S40, When the control signal received at steps S43 and S44 does not include the charge instruction nor the shooting instruction after executing the shot process at step s42-1, or when the shooting process at step S44-1 is executed, the sequence proceeds to step S50. The main gun power D is returned to the standard value, and the charge process 1 ends.

Figure 8:
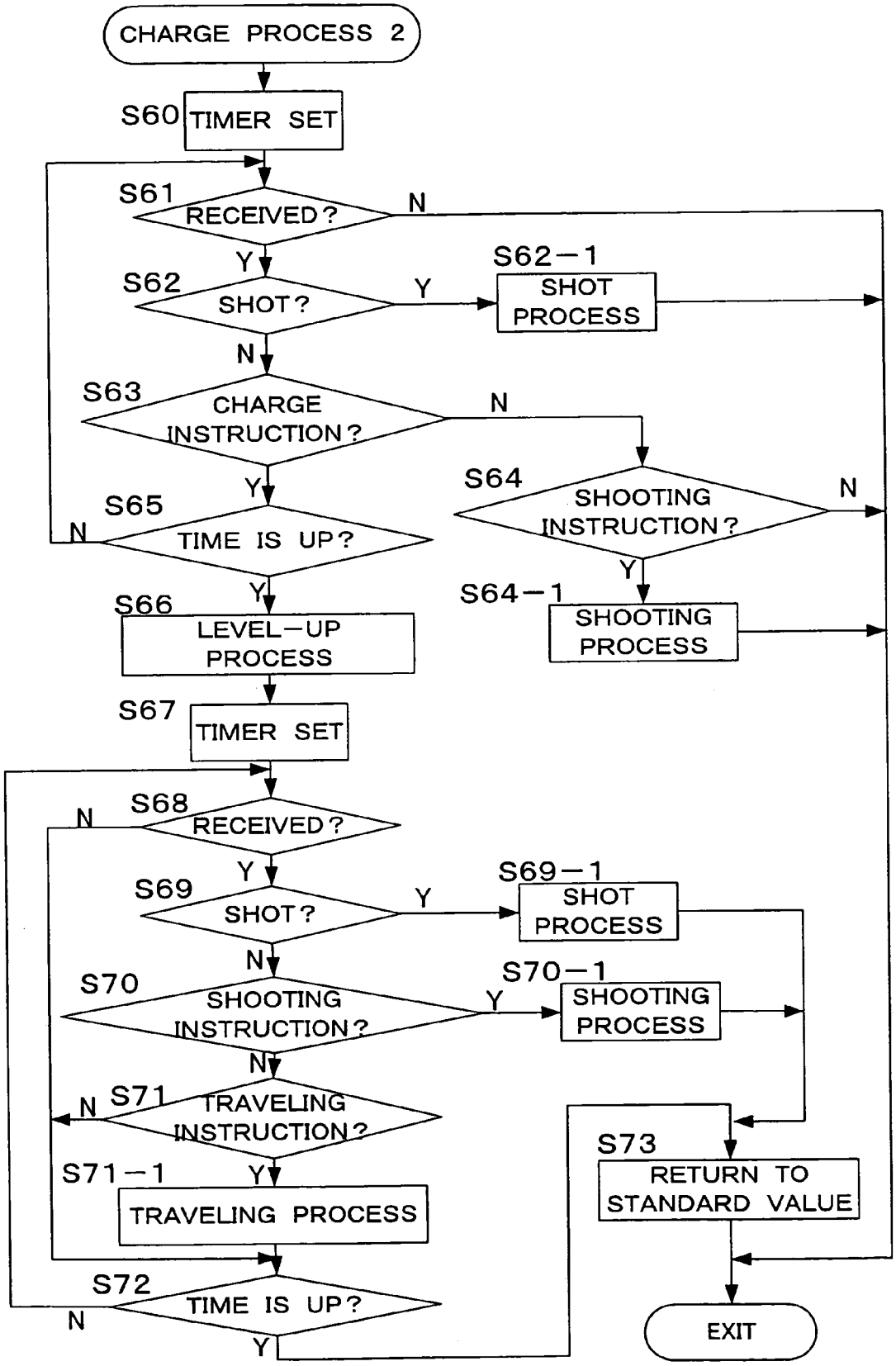
FIG. 8 is a flowchart showing a charge process 2 to be executed by the combat vehicle model in FIG. 1.

The charge process 2 to be executed by the controller 3 will be described according to the flowchart shown in FIG. 8. First, the timer is set (step S60). The timer counts up 4.5 seconds. When the timer counts up the time, the value of the main gun power D held in the RAM 23*a* can be increased. If the control signal including the charge instruction signal representing the charge instruction 2 is not continuously being received during counting the time with the timer, the charge process 2 ends. Also when the command vehicle model 2 is shot or receives the control signal including the shooting instruction during counting the time with the timer, the charge process 2 ends.

The reception state of the receiver 8 is, therefore, monitored at steps S61 to S64. It is judged whether the receiver 8 receives the control signal transmitted to itself or the shooting signal from another command vehicle model 2 (step S61). When it is judged that the receiver 8 does not receive the signals, the charge process 2 ends, and when it is judged that the receiver 8 receives the signals, it is judged whether the command vehicle model 2 is shot (step S62). When it is judged that the command vehicle model 2 is shot, the shot process is executed (step S62-1). The judgement as to the shot and the processes to be executed in the shot process are similar to those in the battle process. After the shot process, the charge process 2 ends.

When it is judged that the command vehicle model 2 is not shot at step S42, it is judged whether the received control signal includes the charge instruction (step S63). When it is judged that the control signal does not include the charge instruction, it is judged whether the control signal includes the shooting instruction (step S64). When the control signal includes the shooting instruction, the shooting process is executed (step S64-1). After the shooting process, the charge process 2 ends. When it is judged that the control signal does not include the charge instruction nor the shooting instruction at steps S63 and S64, the charge process 2 ends.

The judgement whether the control signal includes the charge instruction or the shooting instruction, and the processes to be executed in the shooting process are similar to those in the battle process. When the control signal including the charge instruction is received, it is judged whether the time is up with the timer (step S65). When the time is not up, the sequence returns to step S61 so as to be in the reception monitoring state. When the time is up, the sequence proceeds to the level-up process (step S66). In the level-up process, the controller 23 as the level-up device increases the main gun power D by 3, and makes the LED display device blink for 0.2 second. In the charge process 2, the value of the main gun power D does not change for 4.5 seconds, but the LED display device may blink while its brightness is gradually heightened at each 1.5 seconds after the timer is set.

After the level-up process, the timer is again set (step S67). The timer determines a period of a state that the main gun power D is increased, and in this embodiment, the period is 10 seconds. When, however, the command vehicle model 2 is shot or receives the control signal including the offense instruction during counting the time with the timer, the main gun power D becomes the standard value and the charge process 2 ends. After the timer is set, it is judged whether the receiver 8 receives the control signal transmitted to itself or the offense signal from another command vehicle model 2 (step S68). When the command vehicle model 2 does not receive any signal, the sequence proceeds to step S72 so as to wait for that the charge process 2 ends until the time is up with the time. In the charge process 2, it is not necessary for the command vehicle model 2 to continuously receive the control signal including the charge instruction 2 after the level-up process.

When the receiver 8 receives the control signal to itself or the shooting signal from another command vehicle model 2, it is judged whether the command vehicle model 2 is shot at step S68 (step S69). When it is judged that it is shot, the shot process is executed (step S69-1). After the shot process, the value of the main gun power D is returned to the standard value (step S73), and the charge process 2 ends. The judgement to the shot and the shot process are similar to those in the battle process. When the command vehicle model 2 is not shot, it is judged whether the received control signal includes the shooting instruction (step S70). When the control signal includes the shooting instruction, the shooting process is executed (step S70-1), and after the shooting process, the main gun power D is returned to the standard value (step S73), so that the charge process 2 ends.

When it is judged that the control signal does not include the shooting instruction at step S70, it is judged whether the control signal includes the traveling instruction (step S71). When the control signal includes the traveling instruction, the traveling process is executed (step S71-1). In the charge process 2, it is not necessary for the command vehicle model 2 to receive the control signal including the charge instruction after the level-up process. Since it is not necessary for the user to continuously input the charge instruction 2 into the transmitter, the traveling instruction can be made by the sticks 3*a* and 3*c*. The judgement whether the control signal includes the traveling instruction and the processes to be executed in the traveling process are similar to those in the battle process.

When it is judged that the received signal does not include any signal at steps S69, S70, and S71, the sequence proceeds to step S72. It is judged whether the time is up with the timer at step S72 (step S72), and when the time is up with the timer, the value of the main gun power D returns to the standard value (step S72). The charge process 2 ends. When the time is not up with the timer, the sequence returns to step S68.

A second embodiment for carrying out the invention will be explained below. In the first embodiment, when the control signal includes the charge instruction, the main gun power D is temporarily leveled up by the level-up process, namely, the offense power is raised. In the second embodiment, however, the defense power is temporarily raised by the level-up process. Since the constitution and the processes in the second embodiment are basically the same as those in the first embodiment, only differences will be explained.

A difference in the constitution is such that the controller 23 of the command vehicle model 2 functions as the level-up device which is a relationship change device which changes a relationship between the main gun power included in the shooting signal transmitted from another command vehicle model 2 and the life L held in the RAM 23*a*. The RAM 23*a* holds a related coefficient (not shown) which is changed by the controller 23 functioning as the level-up device.

Further, a difference in the process is as follows. The controller 23 as the shot process device determines the new life L by subtracting the value obtained by the related coefficient x the main gun power included in the shooting signal from its own life L when it is judged that the command vehicle model 2 is shot. Normally the related coefficient is set to 1, and 1 is the standard value. The controller 23 as the level-up device sets the related coefficient so that it is reduced from 1 by each ⅛ in the level-up process at step S47 in the charge process 1. That is, when the level is 0, the related coefficient is 1, when the level is 1, the related coefficient is ⅞, when the level is 2, the related coefficient is ⅚, and when the level is 3, the related coefficient is ⅝.

In the level-up process at step S66 in the charge process 2, the related coefficient is set to ⅞. In the shot process at step S42-1 after the level-up process at step S46 in the charge process 1 and the shot process at step S69-1 after the level-up process at step S66 in the charge process 2, the opponent's main gun power to be reduced becomes smaller than the normal occasion. For this reason, the defense power is leveled up. In this case, the related coefficient returns to 1 as the standard value at steps S50 and S73.

If the input operation to the transmitter 1 for increasing the defense power is set so as to be different from the input operation for increasing the offense power, the user can temporarily increase the defense power as well as the offense power of the command vehicle model 2 according to the input operation to the transmitter 1.

The present invention is not limited to the embodiments, and may be carried out in various modes. For example, the maximum number of command vehicle models 2 which play the battle game simultaneously is not limited to 4, but may be equal to or more or less than 4. The remote control system may use radio waves as carrier waves with different frequencies instead of infrared rays. Further, the driving device is not limited to the command vehicle model 2, but any device which can transmit the offense signal and play the above mentioned battle game may be used. For example, a monstrous beast model, a submarine model, or the like may be used. The parameters which are recorded in the vehicle-by-vehicle ROM 4 may be retained in an involatile memory separately from the RAM 13*a* of the transmitter 1 and the RAM 23*a* of the command vehicle model 2.

The input operation for the charge instruction as a specified operation is not limited to the above mode, but any operation for writing information for discriminating the charge instruction on the driving device side into the control signal may be used. In the above embodiments, a plurality of fields of the existing control signal are used for the information to represent the charge instruction, but 2-bit for example, of the fields for the charge instruction are provided, and when the charge instruction is given, information is written into the field. The command vehicle model 2 may execute the charge process which is adapted for the information written into the fields for the charge instruction.

The maximum value of the level-up process and the width for increasing the level are not limited to the above values, and they may be equal to or more or less than the values. The time counted up with the timer is not limited to the above time, and it may be equal to or more or less than the above time. In the process of increasing the defense power, the value of the main gun power of another command vehicle model 1 included in the received shooting signal may be decreased. In the charge process 2, after the timer is set at step S60, the LED display device may be allowed to blink for several seconds at every 1.5 seconds while its brightness is being gradually heightened.

What is claimed is:

1. A remote control toy system, comprising:

a transmitter which transmits a control signal according to a user's operation; and a driving device which is remotely controlled based on the control signal transmitted from the transmitter, wherein the driving device includes:

a storage device which holds a first parameter and a second parameter;

an offense signal transmitting device which transmits an offense signal including offense information based on the first parameter; and a second parameter change device which receives a specified signal for changing the second parameter and changes the second parameter according to information included in the specified signal, the transmitter and the driving device are combined with another pair of another driving device and another transmitter having the storage device, the offense signal transmitting device, and the second parameter change device, to play a battle game, in the battle game, the driving device receives the offense signal as the specified signal transmitted from the other driving device and changes the second parameter according to the information in the specified signal, the transmitter has a control signal generating device which allows the control signal to include specified information according to a specified operation by a user, the driving device has a first parameter change device which when the driving device does not receive the offence signal from the another driving device during a predetermined time after receiving the control signal including the specified information, changes the own first parameter of the driving device based on the specified information included in the control signal.

2. The remote control toy system according to claim 1, wherein the first parameter and the second parameter are expressed by numerical values, and the offense signal transmitting device transmits the offense signal including the first parameter, in the battle game, the second parameter change device changes the second parameter according to the first parameter included in the offense signal received as the specified signal, the first parameter change device changes the first parameter of the driving device based on the specified information.

3. The remote control toy system according to claim 2, wherein the second parameter change device reduces the first parameter included in the offense signal from the second parameter to change the second parameter, the first parameter change device increases the first parameter of the driving device based on the specified information.

4. The remote control toy system according to claim 1, wherein the first parameter change device returns the first parameter changed based on the specified information to a state before the change, according to a predetermined condition.

5. A driving device which is remotely controlled based on a control signal transmitted from a transmitter according to a user's operation, comprising:

a storage device which holds a first parameter and a second parameter;

an offense signal transmitting device which transmits an offense signal including offense information based on the first parameter; and a second parameter change device which receives a specified signal for changing the second parameter and changes the second parameter according to information included in the specified signal, wherein the driving device can play a baffle game with another driving device which is controlled by another transmitter, the another driving device having the storage device, the offense signal transmitting device, and the second parameter change device, in the baffle game, the driving device in a remote control toy system receives the offense signal transmitted from the another driving device as the specified signal, and changes the second parameter according to the information included in the specified signal, the driving device further comprises a first parameter change device which after the control signal including specified information according to a specified operation by a user is received from the transmitter, when the driving device does not receive the offence signal from the another driving device during a predetermined time, changes the own first parameter of the driving device based on the specified information.

6. A remote control toy system, comprising:

a transmitter which transmits a control signal according to a user's operation; and a driving device which is remotely controlled based on the control signal transmitted from the transmitter, wherein the driving device includes:

a storage device which holds a first parameter and a second parameter;

an offense signal transmitting device which transmits an offense signal including offense information based on the first parameter; and a second parameter change device which receives a specified signal for changing the second parameter and changes the second parameter according to information included in the specified signal, the transmitter and the driving device are combined with another pair of another driving device and another transmitter having the storage device, the offense signal transmitting device, and the second parameter change device, so as to be capable of playing a battle game, in the battle game, the driving device receives the offense signal transmitted from the another driving device and changes the second parameter according to the information in the specified signal, the transmitter has a control signal generating device which allows the control signal to include specified information according to a specified operation by a user, the driving device has a relationship change device which when the driving device does not receive the offence signal from the another driving device for a predetermined time after receiving the control signal including the specified information, changes a relationship between the own second parameter of the driving device and the information included in the offence signal received from the another driving device based on the specified information included in the control signal.

* * * * *